United States Patent [19]

Fujimori

[11] 4,132,062

[45] Jan. 2, 1979

[54] DIGITAL WATCH CASE

[75] Inventor: Yoshiaki Fujimori, Suwa, Japan

[73] Assignee: Kabushiki Kaisha Suwa Seikosha, Tokyo, Japan

[21] Appl. No.: 791,130

[22] Filed: Apr. 25, 1977

[30] Foreign Application Priority Data

Apr. 23, 1976 [JP] Japan ..... 51/47012

[51] Int. Cl.[2] ..... G04B 37/08; G04B 39/00

[52] U.S. Cl. ..... 58/90 R; 58/91

[58] Field of Search ..... 58/88 R, 90 R, 91

[56] References Cited

U.S. PATENT DOCUMENTS

| | | | |
|---|---|---|---|
| 3,643,423 | 2/1972 | Piqueres | 58/88 R |
| 3,683,615 | 8/1972 | Piqueres et al. | 58/88 R |
| 3,789,606 | 2/1974 | Isono | 58/90 R |
| 3,817,025 | 6/1974 | Siegrist | 58/90 R |
| 3,831,372 | 8/1974 | Isono | 58/90 R |
| 3,849,981 | 11/1974 | Tarusawa et al. | 58/90 R |

*Primary Examiner*—Stanley J. Witkowski

*Attorney, Agent, or Firm*—Blum, Moscovitz, Friedman & Kaplan

[57] ABSTRACT

A digital watch case which includes a cylindrical watch barrel, glass cover, glass sealing means and parting plate mounted from the upper end of the barrel, and a back cover mounted from the opposite end. The watch case is characterized in that the thickness of the watch shell is reduced by providing a receiving surface on a flange of the barrel which extends inside the outer surface of the glass cover. The parting plate supports the glass cover and covers the watch body except for the display area. The back cover is secured to the watch shell by a radial spring means attached to the watch back. Packing means are supported on the back cover to engage compressively with the under horizontal surface of the flange and the back cover.

10 Claims, 6 Drawing Figures

DIGITAL WATCH CASE

BACKGROUND OF THE INVENTION

A digital watch normally contains an essentially rectangular shaped display covered by a similarly shaped glass cover. The glass cover is secured in the shell or barrel of the watch by a glass packing. The barrel must accommodate the rectangular shape of the glass cover, however, the inner diameter of the watch barrel and the back cover of the watch are normally circular. This circular shape allows for ease of manufacture of parts and securing the back cover to the barrel. A parting plate of the same shape as the glass cover is provided below the glass cover for support and to cover the watch body other than the display area. The parting plate provides color or decorative appearance to the watch case.

Due to the rectangular shape of the glass cover and circular shape of the watch back together with the need to provide sealing means between the barrel and back, the distance from the outer edge of the glass cover to the outer periphery of the shell is determined by the thickness of the required glass packing and length of packing surface for sealing the back and barrel. As these parts were normally arranged in series in the radial direction from the outer surface of the glass cover, the distance between the outside of the glass cover and the outside of the shell could not be made as small as desired.

SUMMARY OF THE INVENTION

Generally speaking, in accordance with the invention, a digital watch case is provided which overcomes the disadvantages of the prior conventional cases. Simultaneously, this novel construction eliminates these prior defects and enables freedom of design, resulting in a watch case of highly aesthetic appearance. Furthermore, the case is assembled easily by mounting the parts, other than the watch body, forming the upper plane of the case, such as, the glass cover, glass sealing member and parting plate from above the watch barrel.

Accordingly, it is an object of this invention to provide a digital watch case of improved design.

It is a further object of the invention to provide a digital watch case containing a relatively thin watch barrel.

Another object of this invention is to provide a digital watch case which will accept changes in design of the parts comprising the upper plane of the watch case without requiring modification of many parts near the underside of the case.

A further object of the invention is to provide a digital watch case wherein the glass cover, glass sealing material and parting plate are inserted into the watch barrel from above.

Still other objects and advantages of the invention will in part be obvious and will in part be apparent from the specification and drawings.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
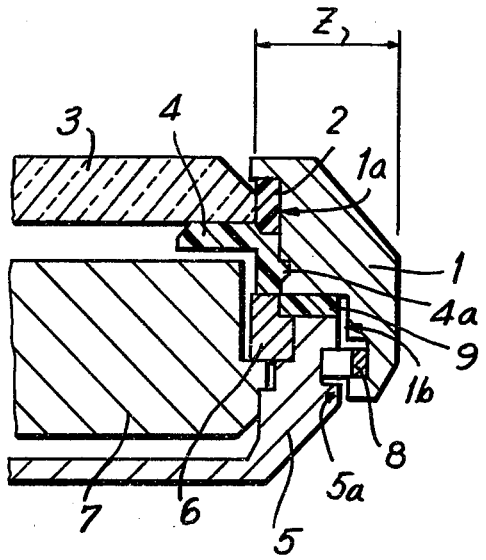
FIG. 1 PRIOR ART
FIG. 1 is a cross-sectional view showing the construction of a conventional digital watch.

Referring now to FIG. 1, a non-circular glass cover, glass packing, parting plate and watch barrel of a type employed in conventional digital watch cases is shown. Watch barrel 1 is provided with a recessed inner surface 1*a* in which glass packing 2 fits along with outer surface 4*a* of parting plate 4. Glass cover 3, glass packing 2 and parting plate 4 are mounted in the watch barrel 1 from the back side through a back side opening of watch barrel 1. Glass cover 3 is secured in position by the innermost diameter at the upper part of barrel 1. Parting plate 4 is supported by the lower surface of glass cover 3. Back cover 5, in which watch body 7 and middle frame 6 for supporting the watch body are housed, contains on its leading surface packing 9. When the watch case is assembled, back cover 5 is dovetailed in barrel 1 so as to compress packing 9 by spring 8 and supports glass cover 3, parting plate 4 and glass packing 2.

According to this prior construction, packing 9 was required to be placed outside barrel inner surface 1*a* for purposes of sealing the back cover and the barrel. Therefore, distance Z from the outer diameter of glass cover 3 to that of barrel 1 is determined by the outside thickness of barrel 1, the contact length of packing 9 required for sealing, and the width of glass packing 2. As these parts were arranged in series in the radial direction from the outer diameter of glass 3, distance Z could not be reduced.

It is undesirable to incorporate a smaller parting plate, and when a large parting plate is used a corresponding enlarging in distance Z results. These design difficulties may be overcome in part if barrel inner surfaces 1*a* and inner diameter 1*b* and watch back are made non-circular in form to match the outer form of glass cover 3. This solution requires an increased number of machinings of the watch barrel and substantially increases the cost of manufacturing the case. In addition, if the outer form of glass cover 3 is then altered in design, almost all the elements of the conventional watch case must be redesigned. This defeats the desired conveniences of the standardization and interchangeability of parts, manufacture and after-service, resulting in an undesirable watch case.

Figure 2:
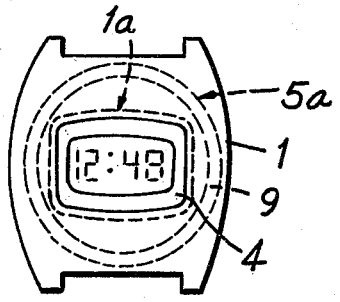
FIG. 2 PRIOR ART
FIG. 2 is a plan view of the conventional digital watch of FIG. 1.

Furthermore, when one desires to construct a watch case which can be machined easily, barrel inner diameter 1*b* and outer diameter 5*a* of back cover 5 must be circular, even though barrel outer diameter 1*a* and parting plate 4 are non-circular. However, in this case it is necessary that barrel inner surface 1*a* be positioned inside shell barrel outer diameter 1*b* and back cover outer diameter 5*a* in order to accommodate packing 9 as shown in FIG. 2. This required positioning of elements results in a narrow parting plate and thick shell resulting in an undesirable watch case design.

Figure 3:
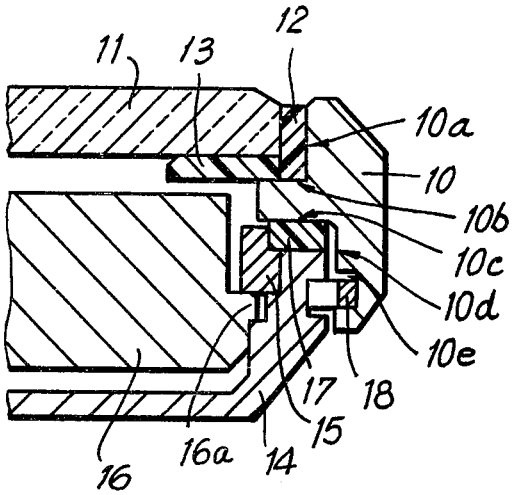
FIG. 3 is a cross-sectional view of a digital watch case constructed in accordance with an embodiment of the invention.

Referring now to FIG. 3, a cross-sectional view of a digital watch case constructed in accordance with an embodiment of the invention is shown. Watch barrel 10 is formed with a non-circular opening on the upper end containing vertical inner surface 10*a* and horizontal parting plate receiving surface 10*b* on a radially extending flange from inner surface 10*a*. The opposite surface of the flange is formed with a horizontal surface defining packing sustaining surface 10*c* which extends outward radially beyond vertical inner surface 10*a*. Back cover 14 is attached to barrel inner diameter 10*d* on the outer side of packing sustaining surface 10*c*. Watch barrel 10 is provided with dovetail groove 10*e* in inner diameter 10*d* to receive radially biased spring 18 attached to the outer vertical diameter of back cover 14.

Glass cover 11, non-circular in shape, is secured in watch barrel 10 by glass packing 12 of radial elasticity. The packing is fabricated from a synthetic resin, soft metal or synthetic rubber which provides an adequate seal between the outer vertical surface of glass cover 11 and barrel inner surface 10*a*. Glass packing 12 is compressed in the radial direction to provide the seal between the two parts.

Parting plate 13 sits below glass cover 11 to cover the upper surface of watch body 16 other than the digital display. The parting plate is fabricated from a metal or synthetic resin and the upper surface may be painted or decorated with a pattern or descriptive mark. Parting plate 13 is positioned below glass cover 11 and supported by parting plate receiving surface 10*b* and glass cover 11. The parting plate in this embodiment is designed so that the outer surface is inside packing member 12 in order to prevent pushing out of glass packing 12. The parts comprising the upper plane of the watch case, (the glass cover, glass sealing member and parting plate) are mounted in watch barrel 10 from above.

Back cover 14 contains middle frame 15 and watch body 16 therein. Watch body 16 contains a radially extending flange 16*a* around the outer periphery thereof with its lower surface supported on back cover 14. Its upper surface supports middle frame 15. Back packing 17 is positioned on the leading edge of back cover 14 and compressed between packing suppressing surface 10*c* and middle frame 15 to provide a seal between back cover 14 and barrel 10.

Spring 18 of radial elasticity is mounted to back cover 14 and dovetails into dovetail groove 10*e* and prevents up and down movement between barrel 10 and back cover 14. Back cover 14 and barrel 10 are properly positioned in the peripheral direction by the engagement of a pipe (not shown) positioned on the outer periphery of back cover 14 with a pipe groove (also not shown) in barrel outer diameter 10*d*. This pipe and pipe groove mounting also prevents any movement between back cover 14 and watch shell 10 in the peripheral direction.

Similarly, the positioning of watch body 16 in the radial direction with respect to parting plate 13 is accomplished by a projection or notch (not shown) on watch body 16 and a projection or notch (also not shown) corresponding thereto provided on back cover 14. When the notch and projection are engaged, watch body 16 is in the proper position with respect to parting plate 13.

In accordance with the invention, the watch case, is assembled by mounting the glass cover, parting plate and glass packing member in the watch barrel from above. Since barrel inner surface 10*a* can be placed in any radial position in relation to packing suppressing surface 10*c*, the earlier restrictions in design of the conventional assembly are overcome, offering an improvement in design of the watch case. In addition, the distance from the outer diameter of glass cover 12 to that of barrel 10 can be reduced providing a watch case of improved appearance.

A digital watch case constructed in accordance with the invention may contain a parting plate of widened surface from the outer diameter of the shell. This results in overcoming the narrow appearance of the conventional assembly and also permits the parting plate surface to be finished in a variety of ways permitting digital watches of improved design. As is evident from the drawings, the cross-sectional form of the parting plate is simplified when compared with the shown conventional assembly. In addition, assembly of the case is simplified and machining of parts can be performed advantageously. Furthermore, a tremendous advantage is gained by the fact that the elements on the back side of the watch are not influenced by the design of the upper planar surface of the watch.

As mentioned earlier, in the conventional assembly, if the outer diameter of the glass cover or the parting plate is varied, most of the elements of the watch case below the packing suppressing surface (i.e., back cover, middle frame, etc.) must also be varied accordingly.

When using the construction of the instant invention, it is not necessary to vary the radial position of packing suppressing surface 10*c* when the outer form of glass 12 or parting plate 13 is varied. The packing, middle frame, back cover and barrel inner diameter need not be redesigned. Furthermore, the outer diameter of the back cover may continue to be circular, even though the outer surface thereof may be non-circular. Thus, the instant invention permits common usage of parts in the lower half of the watch case whenever possible. Thus, a substantial advantage in ease of manufacture is gained as well as in after-service usage.

Figure 4:
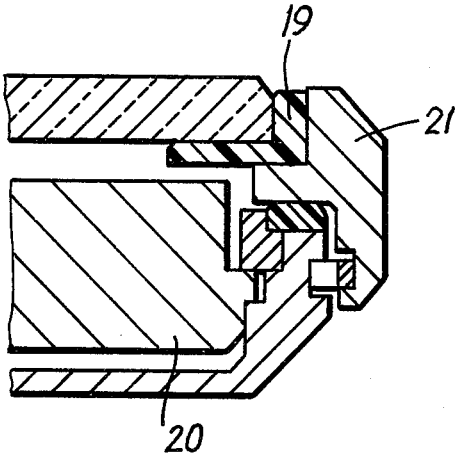
FIG. 4 is a cross-sectional view of a digital watch case constructed in accordance with a second embodiment of the invention.

Referring now to FIG. 4, a cross-sectional view of a second embodiment is shown. Glass packing member 19 is of L-shaped form and serves as a parting plate. The lower surface protrudes above watch body 20 to cover the workings of the watch other than the digital display and may contain a decorative surface as explained above. In this embodiment, the glass cover and sealing member 19 are mounted in watch barrel 21 from above. As the parting plate and sealing member are contained in the same element, it is possible to assembly the watch case with one less part than required in the embodiment shown in FIG. 3.

Figure 5:
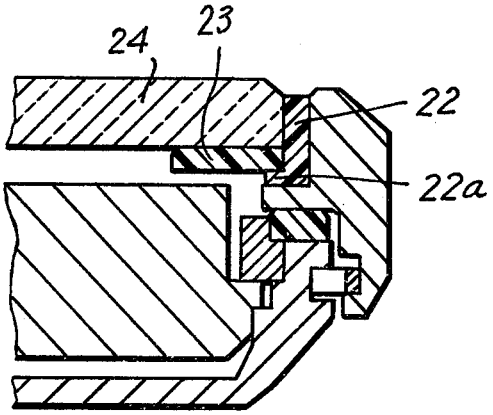
FIG. 5 is a cross-sectional view of a digital watch case constructed in accordance with a third embodiment of the invention.

Referring now to FIG. 5, a cross-sectional view of a third embodiment is shown. Sealing member 22 is also of L-shaped form, however, bottom projection 22*a* supports parting plate 23 and glass cover 24. According to this embodiment of the invention, it is possible to ease shock on glass cover 24 by the elasticity of sealing member 22 thereby improving the shock resistance of the watch while providing the same advantages as obtained in the embodiment of FIG. 3.

Figure 6:
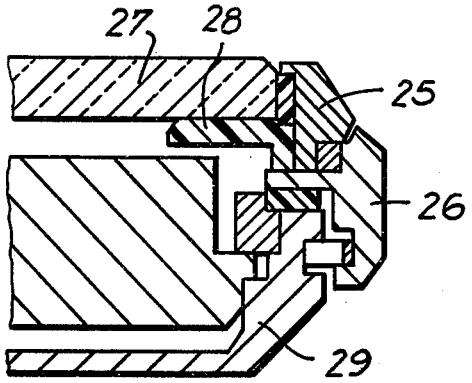
FIG. 6 is a cross-sectional view of a digital watch case constructed in accordance with a fourth embodiment of the invention.

Referring now to FIG. 6, a cross-sectional view of a fourth embodiment is shown. Glass frame 25, which is non-circular in shape, is positioned on watch barrel 26. In this embodiment of the invention, glass cover 27, parting plate 28 and glass frame 25, which all constitute the upper planar surface of the watch case, are mounted into barrel 26 from above. The shape of the inner surface of glass frame 25 may be varied freely to accommodate glass covers of various shapes without varying the outer periphery of the glass frame and without varying the parts in the lower half of the watch case, such as, the back cover, middle frame, and packing member. As above, this embodiment of the invention also provide the same effect and improvements in design as the prior embodiments.

It will thus be seen that the objects set forth above, among those made apparent from the preceding description, are efficiently obtained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention in which, as a matter of language, might be said to fall therebetween.

What is claimed is:

1. A digital watch case for receiving a digital display means comprising:

a watch barrel having an opening therethrough;

a cover glass mounted in the front end of said barrel;

a back cover connectable to the back end of said barrel, said barrel having an inner surface and formed with a flange having a front surface extending inwardly from said inner surface beyond the periphery of said cover glass towards the center of said barrel;

glass packing means compressively mounted between the periphery of said cover glass and the inner surface of said barrel at the front end of said barrel; and a parting plate member supported at least in part by the front surface of said flange, said parting plate member extending inwardly towards the center of said barrel beyond the inner edge of the front surface of said flange and in contact with the bottom surface of said cover glass to define an opening sufficient to permit viewing of a digital display means in said watch case.

2. The watch case of claim 1, wherein said flange has a back surface extending outwardly beyond the inner surface at the front end of said barrel for defining an inner surface at the back end of said barrel, said back cover connectable to the back end of said barrel.

3. The watch case of claim 2, including a back packing member compressably engaged between said back cover and the lower surface of said flange.

4. The watch case of claim 3, including a middle frame releasably mounted on said back cover and engaged by said packing member.

5. The watch case of claim 1, wherein said cover glass is non-circular in shape in plan view.

6. The watch case of claim 3, including a radially biased spring supported by said back cover said watch barrel being formed with a corresponding dovetail groove on the inner surface at the back of said barrel for receiving said spring for releasably connecting said back cover to the back end of said barrel.

7. The watch case of claim 1, wherein said glass packing means and said parting plate member are formed into a unitary substantially L-shaped cross-section for compressably receiving said cover glass between the inner surface of the first end of said watch barrel and the front surface of said flange.

8. The watch case of claim 7, wherein said L-shaped glass packing means is compressably mounted between said cover glass and the front surface of said flange and a second member positioned intermediate said cover glass and the front surface of said L-shaped glass packing means, said second member extending inwardly towards the center of said watch barrel beyond said flange to define an opening sufficient to permit viewing of a digital watch display.

9. The watch case of claim 1, including a glass frame member formed with an outer peripheral shape for registration with the inner surface of the front end of said watch barrel and an inner opening dimension to receive said cover glass, said glass packing means including a first portion compressed intermediate portions of said glass frame member outer periphery and said barrel inner surface and flange front surface and a second portion compressed intermediate said glass plate and said glass frame member.

10. The watch case of claim 9, including a parting plate member of substantially L-shaped cross section and having a first portion extending upwardly from and supported by said flange adjacent said glass frame member and a second portion extending inwardly from said first portion adjacent the underside of said glass plate to define an opening sufficient to permit viewing of a digital display.

* * * * *